United States Patent [19]

Heisig et al.

[11] 4,397,156

[45] Aug. 9, 1983

[54] DISPLACER FOR LOW-TEMPERATURE REFRIGERATING MACHINES

[75] Inventors: Rolf Heisig, Weilerswist; Hans-Hermann Klein, Hurth; Karl-Heinz Völker, Julich, all of Fed. Rep. of Germany

[73] Assignee: Leybold Heraeus GmbH, Postfach, Fed. Rep. of Germany

[21] Appl. No.: 313,697

[22] Filed: Oct. 21, 1981

[30] Foreign Application Priority Data

Nov. 26, 1980 [DE] Fed. Rep. of Germany ..... 3044427

[51] Int. Cl.[3] ..... F25B 9/00

[52] U.S. Cl. ..... 62/6; 165/10

[58] Field of Search ..... 62/6; 165/4, 10, DIG. 10

[56] References Cited

U.S. PATENT DOCUMENTS

| | | | |
|---|---|---|---|
| 2,946,681 | 7/1960 | Probst et al. | 165/DIG. 10 |
| 3,218,815 | 11/1965 | Chellis et al. | 62/6 |
| 3,397,738 | 8/1968 | Daunt | 62/6 |
| 3,678,992 | 7/1972 | Daniels | 165/10 |
| 3,794,110 | 2/1974 | Severijns | 62/6 |
| 4,231,418 | 11/1980 | Lagodmos | 62/6 |

*Primary Examiner*—Ronald C. Capossela

*Attorney, Agent, or Firm*—Felfe & Lynch

[57] ABSTRACT

A displacer for low-temperature refrigerating machines having a regenerator disposed in a hollow space of the displacer, wherein the regenerator is formed at least in part of a sintered material, preferably sintered bronze spheres.

13 Claims, 4 Drawing Figures

DISPLACER FOR LOW-TEMPERATURE REFRIGERATING MACHINES

BACKGROUND OF THE INVENTION

The invention relates to a displacer for low-temperature refrigerating machines comprising a regenerator disposed in a hollow space of the displacer.

Low-temperature refrigerating machines are cooling equipment in which thermodynamic cycles operate. (See, for example, U.S. Pat. No. 2,906,101.) A single-stage low-temperature refrigerating machine essentially comprises a chamber with a displacer. The chamber is alternately connected in a given manner to a high-pressure gas source and a low-pressure gas source, with the thermodynamic cycle (Stirling cycle, McMahon/Gifford cycle, etc.) operating during the reciprocating motion of the displacer. The working gas neon cryogenic fluid may be carried in a closed cycle. As a result, heat is abstracted from a given region of the chamber. With two-stage refrigerating machines of this type and helium as the working gas temperatures down to 10° K. and lower can be produced.

An essential component of a low-temperature refrigerating machine is the regenerator through which the working gas flows before and after expansion. It is known to locate the regenerator within the cylindrical displacer. In this case, the regenerator must have good heat-storing properties in order that a sufficiently high heat exchange may take place between the working gas and the regenerator. Moreover, the displacer as a whole must then be a poor heat conductor as otherwise the heat abstracted from one side of the chamber is quickly replaced through thermal conduction. Known regenerator materials are bronze or lead spheres, bronze wool and bronze gauze.

A drawback of displacers comprising these regenerator materials is that their overall manufacture is expensive and complicated. When the regenerator material consists of spheres, gas-permeable caps or grids must be provided to prevent the spheres from dropping out. Bronze gauze is expensive and difficult to introduce into the hollow interior of the displacer. Bronze wool poses much the same problem as spheres. No part thereof may be allowed to get out as otherwise the chamber walls might be damaged.

SUMMARY OF THE INVENTION

The object of the present invention is to provide a displacer of the type mentioned above which is much simpler to produce and which eliminates the risk of regenerator material dropping out.

In accordance with the invention, this object is accomplished by using a regenerator made at least in part of a sintered material, preferably sintered bronze spheres. Sinteredmaterial bodies can be produced with high accuracy in any desired size, and a displacer in accordance with the invention can therefore be fabricated with a great many fewer parts than prior-art displacers. The usual variations in packing density of conventional regenerators also are not encountered.

Since a sintered material has better heat-conducting properties than the usual regenerator material, it is advisable to arrange a plurality of sintered-metal disks spaced axially in a row. In this way, heat conduction can be reduced to the required level.

It is also possible to locate sintered-metal disks only at one end or both ends of the regenerator space and to use conventional regenerator material (bronze wool, lead spheres or the like) between these disks. The sintered-metal disks then have a dual function, serving both as gas-permeable cover disks and as actual regenerators, so that optimum use is made of the available regenerator space.

Further advantages and details of the invention will now be described with reference to embodiments illustrated in the accompanying drawings wherein:

DETAILED DESCRIPTION OF THE INVENTION

Figure 1:
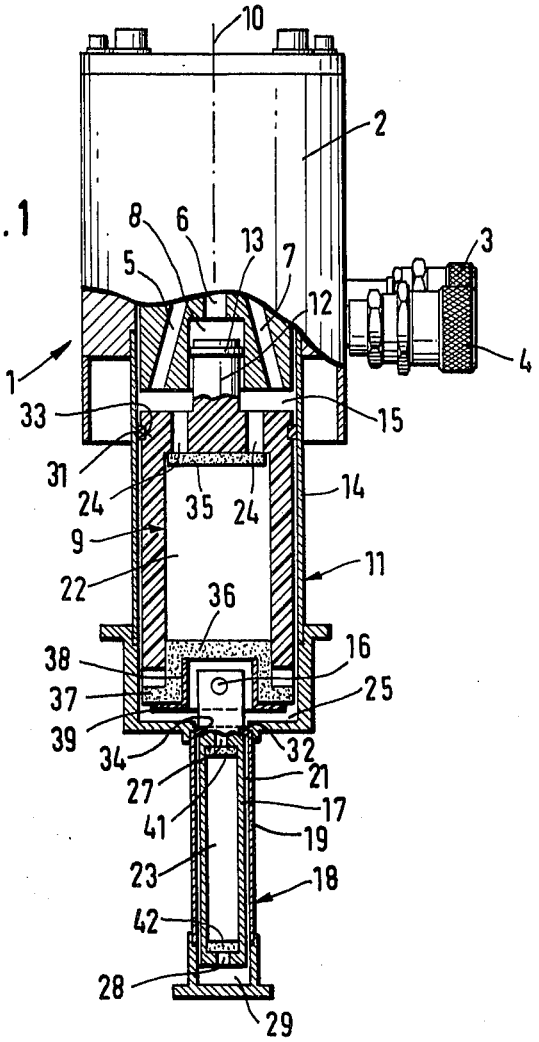
FIG. 1 is a partial sectional view of a refrigerating machine according to the present invention.

FIG. 1 shows a two-stage low-temperature refrigerating machine partly in section. In the housing 2 there is conventionally accommodated, in a manner not shown in detail, a valve system which connects a high-pressure gas source and a low-pressure gas source from pipes 3 and 4 in a given sequence to conduits 5, 6 and 7. Conduit 6 terminates in a cylinder 8 in which a drive piston 12 connected to the displacer 9 of the first stage 11 of the refrigerating machine is disposed. A ring which serves as a seal between the piston 12 and the inside wall of the cylinder 8 is designated 13. By means of this drive the displacer 9 is reciprocated in the chamber 15 formed by the cylindrical casing 14. The displacer 17 of the second stage 18 of the refrigerating machine is secured to the first-stage displacer 9 through a pin 16, with the result that the displacer 17 also executes a reciprocating movement in the chamber 21 formed by the cylindrical casing 19. The axis of the system as a whole is designated 10.

The displacers 9 and 17 are substantially cylindrical. Their hollow interiors 22 and 23 serve to accommodate the regenerators, described in greater detail further on.

The working gas is admitted and exhausted through the conduits 5 and 7, respectively. Passing through bores 24, it flows through the regenerator in the displacer 9 and into an expansion space 25 which forms the lower part of the chamber 15. There it expands and abstracts heat from this region of the first stage 11 of the refrigerating machine. The precooled gas then flows through a bore 27 in the displacer 17 of the second stage 18, through the regenerator disposed in the interior 23 of said displacer 17, and through a bore 28 at the lower end of the displacer 17 into an expansion space 29 of the second stage 18. There further expansion takes place, attended by cooling of this region of the second stage. The gas returns over the same path and in so doing cools the regenerator materials, with the result that the gases admitted in the next cycle are precooled in the regenerator.

Sealing rings 31 and 32 which are accommodated in external grooves 33 and 34 in the displacer walls provide sealing action between the displacers 9 and 17 and their associated chamber walls 14 and 19.

The object of the present invention being to provide a simple design for the displacers 9 and 17 and the associated regenerators, the displacer 9 along with its drive piston 12 is of one-piece construction and preferably made of a fiber-filled plastic. The regenerator is formed by a sintered-metal disk 35, a cup-shaped part 36, and regenerator material (not shown) accommodated between these two members. Said material may conventionally consist of bronze wool or bronze spheres. The sintered-metal disk 35 assures that no regenerator material will pass through the bores 24.

Part 36 is cup-shaped and has a relatively wide flange 37 and by its bottom portion seals the interior 22 of the displacer 9. Its flange serves to limit the reciprocating movement of the piston sys m. If said part is made of a plastic, its flange will further provide damping of the displacer motion. Plastics are impermeable to gases, and passages (not shown) would therefore have to be provided for the working gas. Such passages are not required when the cup-shaped part is formed of a sintered material, as shown in FIG. 1. It will then be permeable to the working gas, will prevent regenerator-material particles from getting out of the hollow space 22, will itself have regenerator action, and will serve to hold the pin 16.

A particularly advantageous embodiment is shown in FIG. 1. The cup-shaped sintered-metal part 36 described above serves as closure for the regenerator space 22 of the displacer 9. Set into said part 36 is a further approximately cup-shaped part 38 whose flange 39 serves as a damping element.

The second-stage regenerator comprises two sintered-metal disks 41 and 42 whose function is likewise to prevent the regenerator material disposed between them, which may be of any desired type, from passing through the bores 27 and 28. Since the sintered material itself is a suitable regenerator, optimum use is made of the available space.

Figure 2:
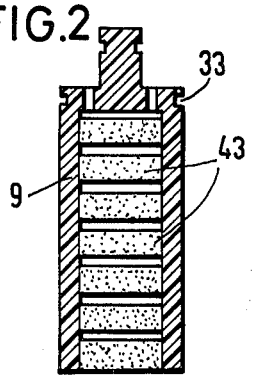
FIGS. 2–4 are sectional views of alternative embodiments of the displacer of FIG. 1.
Figure 3:
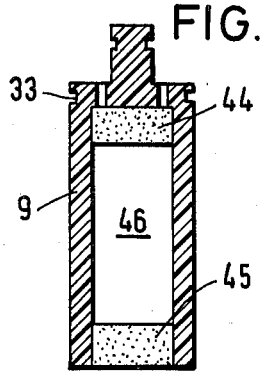
Figure 4:
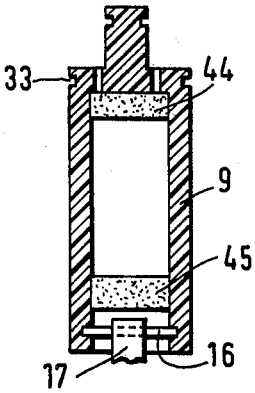

FIGS. 2, 3 and 4 illustrate further possible embodiments of a displacer. In the embodiment according to FIG. 2, a plurality of sintered-metal disks 43 is disposed in the displacer. They are slightly spaced from one another to provide for sufficiently high thermal resistance.

The embodiment according to FIG. 3 essentially corresponds to the displacer 17 of the second stage 18 of the refrigerating machine shown in FIG. 1. Here only two sintered-metal disks 44 and 45 are provided, and these bound the space 46, which is filled with conventional regenerator material. In the embodiment according to FIG. 4, the lower sintered-metal disk is disposed so that the pin 16 can be mounted at the lower edge of the displacer 9 for securing the second-stage displacer 17.

It will be appreciated that the instant specification and claims are set forth by way of illustration and not of limitation, and that various changes and modifications may be made without departing from the spirit and scope of the present invention.

What is claimed is:

1. In a displacer for a low-temperature refrigerating machine, the displacer having a hollow space with one end of the hollow space adapted for receiving and exhausting a working gas and the other end adapted for communicating with an expansion space and a regenerator of low heat conductivity in the hollow space, the improvement to the displacer comprising: a sintered material member closing the hollow space at least at one end of the displacer, whereby the sintered material may form at least part of the regenerator in the hollow space.

2. The displacer according to claim 1, wherein the sintered material comprises sintered bronze spheres.

3. The displacer according to claim 1 or claim 2, wherein the hollow space is elongated and the regenerator comprises a plurality of sintered-metal disks spaced from each other in a row, each disc being generally normal to the longitudinal axis of the hollow space.

4. The displacer according to claim 1 or claim 2, and further comprising a sintered-material member closing the other end of the hollow space, whereby the remaining hollow space between the sintered members may be filled with regenerator material.

5. The displacer according to claim 1 or claim 2, and further comprising a cup-shaped element having its inner portion inserted into the other end of the hollow space.

6. The displacer according to claim 5, wherein the cup-shaped element comprises a plastic and wherein its flanged portion serves to limit the displacer movement.

7. The displacer according to claim 6, wherein the cup-shaped element comprises means for attachment of a further displacer stage.

8. The displacer according to claim 5, wherein the cup-shaped element comprises a sintered material and has a bottom portion closing the other end of the hollow space.

9. The displacer according to claim 8, wherein the cup-shaped element comprises means for attachment of a further displacer stage.

10. The displacer according to claim 8, wherein a separate damping element made of a plastic is provided on the cup-shaped element.

11. The displacer according to claim 8, further comprising a cup-shaped damping element fitted cup-to-cup in the cup-shaped sintered element.

12. The displacer according to claim 1, having a one-piece construction, except for the regenerator material.

13. The displacer according to claim 12, further comprising a drive piston integral therewith.

* * * * *